US006397399B1

(12) United States Patent
Lampe et al.

(10) Patent No.: US 6,397,399 B1
(45) Date of Patent: Jun. 4, 2002

(54) PROTECTIVE HEADGUARD

(75) Inventors: John K. Lampe; Robert C. Long; George C. Halvorson, all of St. Paul, MN (US)

(73) Assignee: Soccerdocs Inc., St. Paul, MN (US)

( * ) Notice: Subject to any disclaimer, the term of this patent is extended or adjusted under 35 U.S.C. 154(b) by 0 days.

(21) Appl. No.: 09/643,392

(22) Filed: Aug. 22, 2000

Related U.S. Application Data

(60) Provisional application No. 60/150,185, filed on Aug. 23, 1999.

(51) Int. Cl.[7] ..... A63B 71/10

(52) U.S. Cl. ..... 2/425; 2/171.2; 2/209.13; 2/411; 2/422

(58) Field of Search ..... 2/417, 425, 410, 2/411, 412, 414, 418, DIG. 11, 422, 7, 421, 171.2, 181.2, 181.4, 181.8, 183, 209.13, 209.14; 607/110

(56) References Cited

U.S. PATENT DOCUMENTS

| | | | | |
|---|---|---|---|---|
| 532,567 A | | 1/1895 | Larwood, Jr. | |
| 1,209,093 A | * | 12/1916 | Whitlow | |
| 2,391,335 A | * | 12/1945 | O'Brien | |
| 2,969,547 A | | 1/1961 | Dye | 2/3 |
| 3,159,160 A | * | 12/1964 | Ullom | |
| 3,171,133 A | | 3/1965 | Steffen | 2/3 |
| 3,725,956 A | | 4/1973 | Reisen | 2/200 |
| 3,784,984 A | | 1/1974 | Aileo | 2/3 R |
| 3,992,721 A | | 11/1976 | Morton | 2/3 R |
| 4,023,209 A | | 5/1977 | Frieder, Jr. et al. | 2/6 |
| 4,044,400 A | | 8/1977 | Lewicki et al. | 2/421 |
| 4,058,854 A | | 11/1977 | Rhee | 2/412 |
| 4,062,067 A | | 12/1977 | Franzen | 2/410 |
| 4,075,717 A | | 2/1978 | Lemelson | 2/412 |
| 4,204,543 A | * | 5/1980 | Henderson | |
| 4,239,106 A | | 12/1980 | Aileo | 206/223 |
| 4,290,149 A | | 9/1981 | Aileo | 2/414 |
| 4,317,239 A | | 3/1982 | Bryksa | 2/411 |
| 4,345,336 A | | 8/1982 | Plastino | 2/187 |
| 4,354,284 A | | 10/1982 | Gooding | 2/413 |
| 4,398,306 A | | 8/1983 | Gooding | 2/421 |

(List continued on next page.)

FOREIGN PATENT DOCUMENTS

| | | | |
|---|---|---|---|
| FR | 2 390 116 | 5/1977 | A41D/21/00 |
| GB | 2 202 729 A | 10/1988 | A42B/3/00 |
| GB | 2 318 500 A | 4/1998 | A63B/71/10 |
| GB | 2 333 690 A | 8/1999 | A63B/71/10 |
| WO | WO 88/04188 | 6/1988 | A63B/71/10 |
| WO | WO 99/29199 | 6/1999 | A42B/3/00 |

OTHER PUBLICATIONS

Seven Photographs of "Gilbert Rugby" head protector, date unknown.

Seven Photographs of "CCC" head protector, date unknown.

Fellow, Fishbein, "Can Sports–Minded Kids Have Too Many Helmets?", *Medical News and Perspectives*, vol. 275, No. 18, p. 1391, May 8, 1996.

Tysvaer, Alf Thorvald, Head and Neck Injuries in Soccer, Impact of Minor Trauma, *Sports Medicine*, vol. 14, No. 3, p. 200–213, 1992.

*Primary Examiner*—Rodney M. Lindsey
(74) *Attorney, Agent, or Firm*—Michael S. Sherrill

(57) ABSTRACT

A protective headguard including (i) a protective central pad for covering at least a portion of an athlete's forehead, (ii) a rear pad for covering at least a portion of an athlete's occipital bone, (iii) a sleeve interconnecting the central pad and the rear pad and covering at least a portion of the interior and exterior surfaces of the central and rear pads, and optionally (iv) an adjustment strap system interconnecting the rear pad and the central pad, (v) a packet of cooling material retained by the sleeve, and/or (vi) nubbins projecting from the interior surface of the central and/or rear pad.

15 Claims, 27 Drawing Sheets

U.S. PATENT DOCUMENTS 4,404,690 A 9/1983 Farquharson ..... 2/420
4,443,891 A 4/1984 Blomgren et al. ..... 2/414
4,481,681 A 11/1984 Hankin ..... 2/197
4,484,364 A 11/1984 Mitchell et al. ..... 2/413
4,539,715 A 9/1985 Clement ..... 2/420
4,558,470 A 12/1985 Mitchell et al. ..... 2/414
4,581,773 A 4/1986 Cunnane ..... 2/204
4,612,672 A 9/1986 Schrack ..... 2/68
4,613,993 A 9/1986 Steele et al. ..... 2/411
4,646,367 A 3/1987 El Hassen ..... 2/411
4,698,852 A 10/1987 Romero ..... 2/171
4,706,305 A 11/1987 Cho ..... 2/425
4,710,985 A 12/1987 Dubner et al. ..... 2/425
4,766,614 A 8/1988 Cantwell et al. ..... 2/414
4,768,231 A 9/1988 Schrack ..... 2/12
4,790,035 A 12/1988 Whyte ..... 2/207
4,827,537 A 5/1989 Villa ..... 2/410
4,843,642 A 7/1989 Brower ..... 2/6
4,847,921 A * 7/1989 Leutholt et al.
4,854,319 A * 8/1989 Tobin
4,864,662 A 9/1989 Frank ..... 2/183
4,910,804 A 3/1990 Lidgren ..... 2/209
4,947,488 A 8/1990 Ashinoff ..... 2/181
4,982,451 A 1/1991 Graham ..... 2/410
5,012,533 A 5/1991 Raffler ..... 2/420
5,042,093 A 8/1991 Legendre ..... 2/419
5,044,016 A 9/1991 Coombs ..... 2/414
5,075,903 A 12/1991 Richoux ..... 2/411
5,081,717 A 1/1992 Shedd et al. ..... 2/199
5,083,321 A 1/1992 Davidsson ..... 2/421
5,173,970 A 12/1992 Shifrin ..... 2/410
5,177,815 A 1/1993 Andujar ..... 2/411
5,184,354 A 2/1993 Alfaro et al. ..... 2/425
5,197,292 A * 3/1993 McPherson
D339,677 S 9/1993 Kang ..... D2/512
5,271,103 A 12/1993 Darnell ..... 2/418
5,315,718 A 5/1994 Barson et al. ..... 2/418
5,337,420 A * 8/1994 Haysom et al.
5,361,420 A 11/1994 Dobbs et al. ..... 2/425
5,392,468 A 2/1995 Leddick, III ..... 2/424
5,421,035 A 6/1995 Klose et al. ..... 2/411
5,437,064 A 8/1995 Hamaguchi ..... 2/414
5,450,631 A 9/1995 Egger ..... 2/425
5,504,945 A 4/1996 Purnell ..... 2/425
5,511,250 A 4/1996 Field et al. ..... 2/418
D370,309 S 5/1996 Stucky ..... D29/102
5,515,546 A 5/1996 Shifrin ..... 2/410
5,519,895 A 5/1996 Barnes, Jr. ..... 2/422
5,535,454 A 7/1996 Ryan ..... 2/425
5,539,934 A * 7/1996 Ponder
5,544,367 A 8/1996 March, II ..... 2/410
5,551,094 A 9/1996 Navone ..... 2/421
5,557,807 A * 9/1996 Hujar et al.
5,615,419 A 4/1997 Williams ..... 2/411
5,628,071 A 5/1997 Nezer ..... 2/410
5,638,551 A 6/1997 Lallemand ..... 2/421
5,640,721 A 6/1997 Jackson ..... 2/171
5,659,900 A 8/1997 Arney et al. ..... 2/417
5,661,854 A 9/1997 March, II ..... 2/410
5,680,656 A 10/1997 Gath ..... 2/424
5,701,609 A 12/1997 Bridges ..... 2/422
5,704,072 A 1/1998 Garneau ..... 2/421
5,774,901 A 7/1998 Minami ..... 2/421
5,790,988 A 8/1998 Guadagnino, Jr. et al. ..... 2/411
5,815,847 A 10/1998 Holden, Jr. ..... 2/418
5,826,277 A * 10/1998 McConville
5,862,528 A 1/1999 Saijo et al. ..... 2/411
5,882,205 A 3/1999 Peterson ..... 434/251
D410,768 S 6/1999 Hirsh ..... D29/102
5,926,849 A * 7/1999 Boyle
5,930,841 A * 8/1999 Lampe et al.
5,946,734 A 9/1999 Vogan ..... 2/412
5,963,989 A 10/1999 Robertson ..... 2/411
6,000,062 A 12/1999 Trakh ..... 2/171
6,065,159 A 5/2000 Hirsh ..... 2/425

* cited by examiner

PROTECTIVE HEADGUARD

This application claims the benefit of United States Provisional Application No. 60/150,185, filed Aug. 23, 1999.

FIELD OF INVENTION

The present invention generally relates to protective headguards for athletics and, more particularly, relates to a protective headguard for soccer players. The purpose of the headguard is to provide protection to a soccer player's head from injuries encountered during play of the game without unduly disrupting the traditional way in which the game is played.

BACKGROUND

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, soccer players have not worn any protective headgear. This is probably the case for two main reasons. First, soccer players or organizers of the game may not have sensed a need to use headgear because injuries to the head may not have seemed as commonplace as in sports such as football, hockey, and bicycling. Second, soccer is one of the few sports where the head itself is intentionally and legitimately used to strike the ball. This requires considerable muscle coordination and use of the senses of sight and touch. An improperly constructed piece of headgear may hamper a player's ability to head the ball properly.

Recent medical research has demonstrated that head injuries may be more prevalent in soccer than previously thought. Several studies have suggested that soccer players may suffer minor trauma from repeatedly heading the ball. This injury has been analogized to pugilistic dementia, the harm that boxers suffer from repeated strikes to the head in boxing. Alf Thorvald, Head and Neck Injuries in Soccer—Impact of Minor Trauma, *Sports Medicine*, 14(3):200–213 (1992). This danger of trauma in soccer may be greater for children. Their skills at heading are less well honed. Their bodies may not be developed enough to withstand or counteract the blow caused by a ball. Id. at 210. Therefore, at least from a safety standpoint, use of headgear by soccer players seems advisable.

The unique demands of the sport of soccer require unique headgear. Although multipurpose protective headgear for sports are being developed, most forms of headgear for use in team sports are intended for one sport and should not be used in other activities. Thomas B. Cole, Can Sports Minded Kids Have Too Many Helmets?, *Journal of the American Medical Association*, 275(18): 1391 (May 8, 1996). A brief review of patents for headgear constructed for other sports shows how such headgear would not meet the specialized needs of soccer players. For example, football and hockey helmets are ill-suited for soccer. Their bulk would likely discourage soccer players unaccustomed to helmets from wearing them. In addition this bulk and the hard, sometimes uneven surfaces of such helmets would make it very difficult to control the direction and distance of a headed ball. Finally, other unprotected soccer players might suffer injuries caused by the hard-surfaced headgear of the wearer. See, e.g., U.S. Pat. No. 4,404,690 (hockey helmet).

Other helmets would also not work effectively as soccer headgear. Bicycle helmets are light but would make control of the ball difficult; they are built to withstand one substantial blow; and their ventilation systems would likely not be effective in soccer. See, e.g., U.S. Pat. No. 5,450,631. Wrestling headgear protects the ears and only incidentally, if at all, protects the surfaces of the head. See, e.g., U.S. Pat. No. 5,361,420.

U.S. Pat. No. 4,698,852 illustrates protective headgear specifically designed for use in soccer. This headgear, however, has several shortcomings. The headband shape of the headgear protects only the forehead, neglecting other parts of the head which may be used, properly, and improperly, to strike balls. The headband shape moreover creates a ridge at the edge of the headband which may misdirect a headed ball. In addition, the materials and retention system of this headgear likely would cause the headgear to slip up or down on the wearer's head or, if tightened, may strain the wearer's head.

SUMMARY OF THE INVENTION

Generally, the present invention relates to improvements to a headguard for athletes and in particular soccer players. One embodiment of the invention is a headguard which includes a headband which encircles the head from the forehead to the back of the head with the portion on the top of the head open. The headband may be made of stretchable material and have adjustment straps. The headband has shock absorbing materials such as foam, gels or other padding. The headband may have a cooling system with material incorporated into the headband that cools the head.

The above summary of the present invention is not intended to describe each illustrated embodiment of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
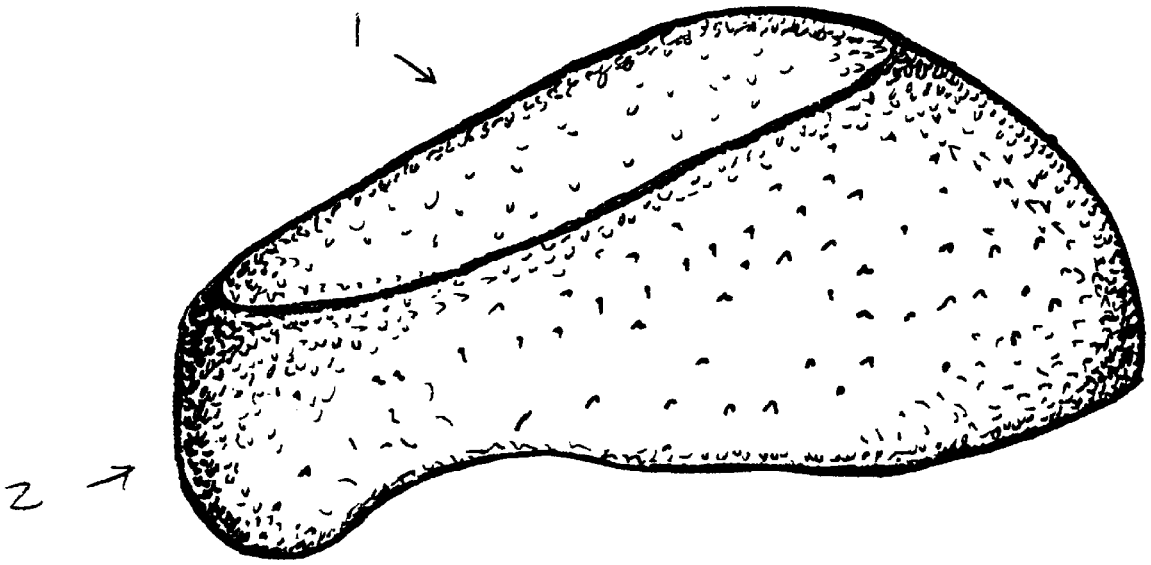
FIG. 1 Side view of an exemplary headguard in accordance with one embodiment of the invention.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims of this invention or those made in the Previous Patent Applications. On the contrary, the intention is to cover all modifications, equivalents, and alternatives falling within the spirit and scope of the invention as defined by the appended claims.

DETAILED DESCRIPTION OF THE INVENTION INCLUDING A BEST MODE

The present invention is believed to be applicable to a number of different sports and is particularly suited to soccer where a player intentionally strikes the ball with the head. While the present invention is not so limited, an appreciation of various aspects of the invention will be gained through a discussion of the exemplary embodiments in connection with the examples provided below.

The padding is typically sufficiently flexible so as to conform to unique head shapes and sizes. The position of the padding may be suitably selected in consideration of the particular environment in which the headguard is worn. For example, when used during the play of soccer, the padding may be positioned to provide a relatively uniform exterior surface over portions of a player's head which generally come in contact with a soccer ball, thus allowing greater control of the ball.

The thickness of the padding may be suitably selected in consideration of the portion of the head which the padding is to cover as well as in consideration of the particular environment. in which the headguard is worn. For example, the thickness of the padding may vary among the top, front, side, and back portions of the padding. Pad thickness around, for example, ½ to 1 and ½ inches, would be suitable for many applications. Suitable padding material includes solid and/or laminated foam, and foam formed from plastic, for example. The fabric covering may be made of stretchable material.

Figure 2:
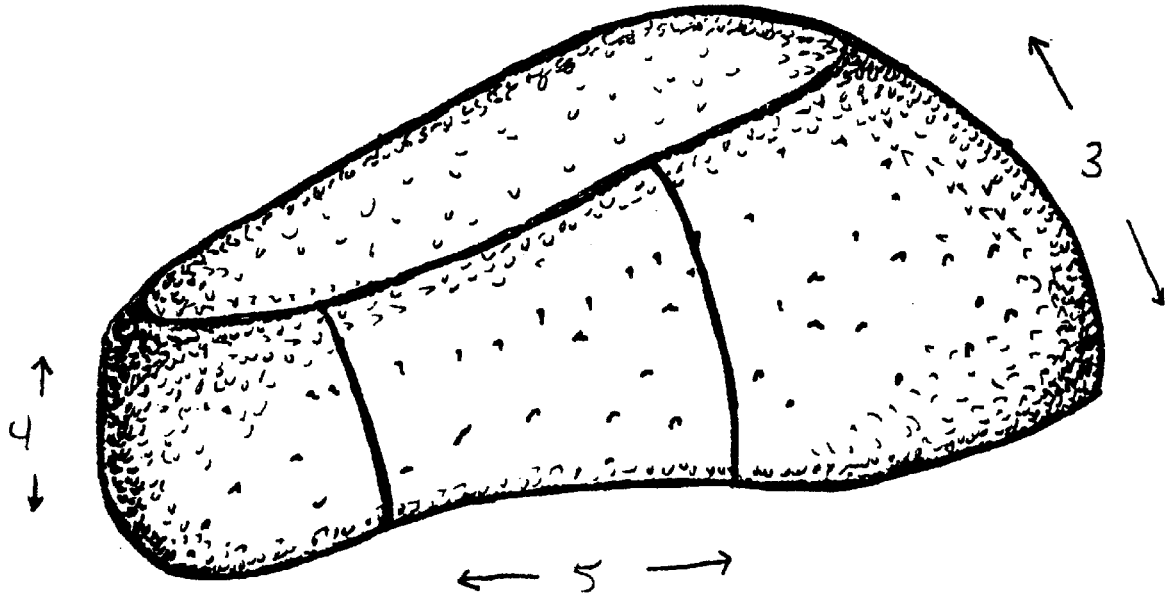
FIG. 2 Side view of an exemplary headguard in accordance with one embodiment of the invention.

In one embodiment the fabric covering 1 encircles the head entirely from the forehead to the occipital bone as shown in FIG. 1. The fabric covering 1 the forehead extends from the brow to above the frontal bone. At the rear, the fabric generally covers the occipital bone 2. The fabric 1 may be pieced together so that the fabric stretches in different directions. For example, it may be desirable for the fabric to stretch up and down at the front and back areas to accommodate the padding inserts and horizontally along the sides to aid in sizing the headband to the width of the head of the wearer. FIG. 2 shows three such panels of fabric with the front 3 and back 4 panels stretching vertically and the side panel 5 stretching horizontally.

Figure 3:
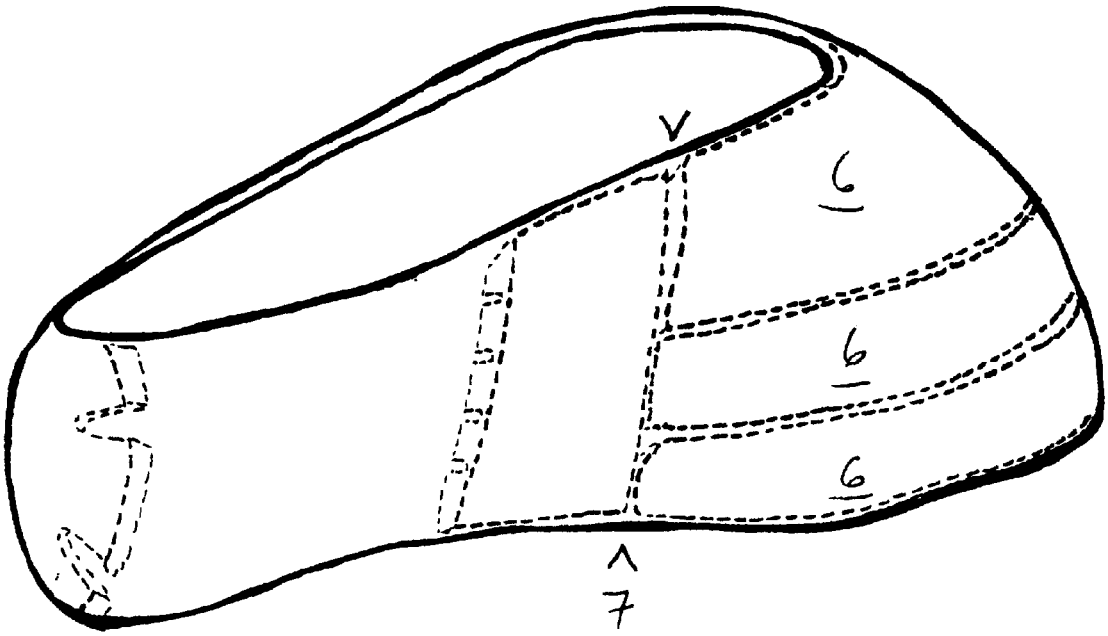
FIG. 3 Side view of an exemplary headguard showing placement of padding in one embodiment.
Figure 4:
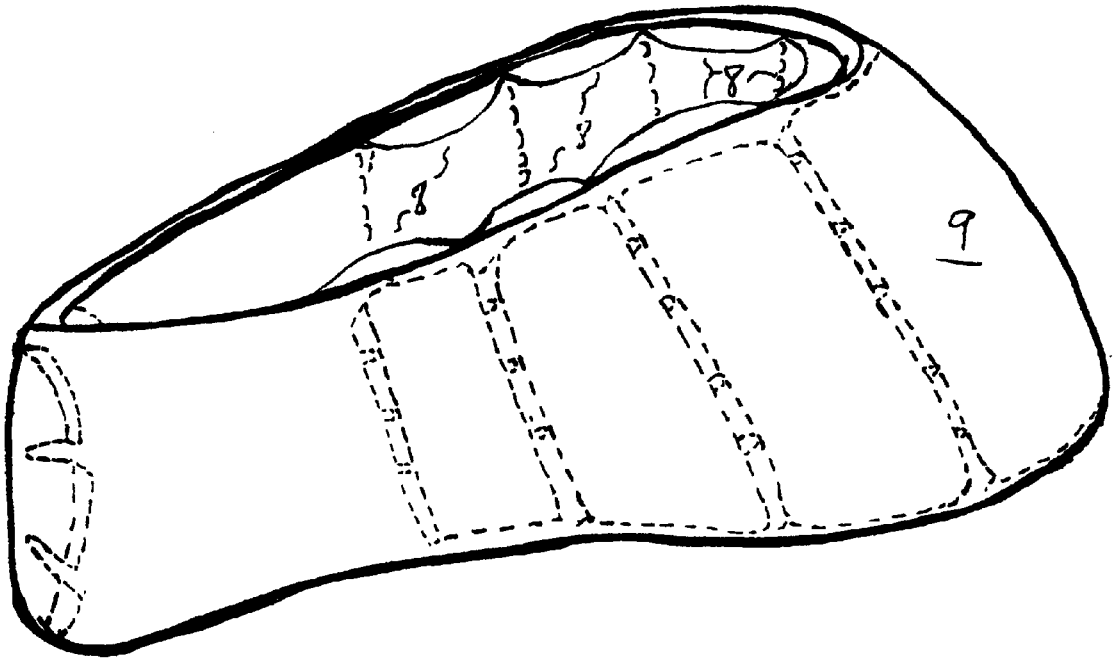
FIG. 4 Side view of an exemplary headguard showing placement of padding in one embodiment.
Figure 5:
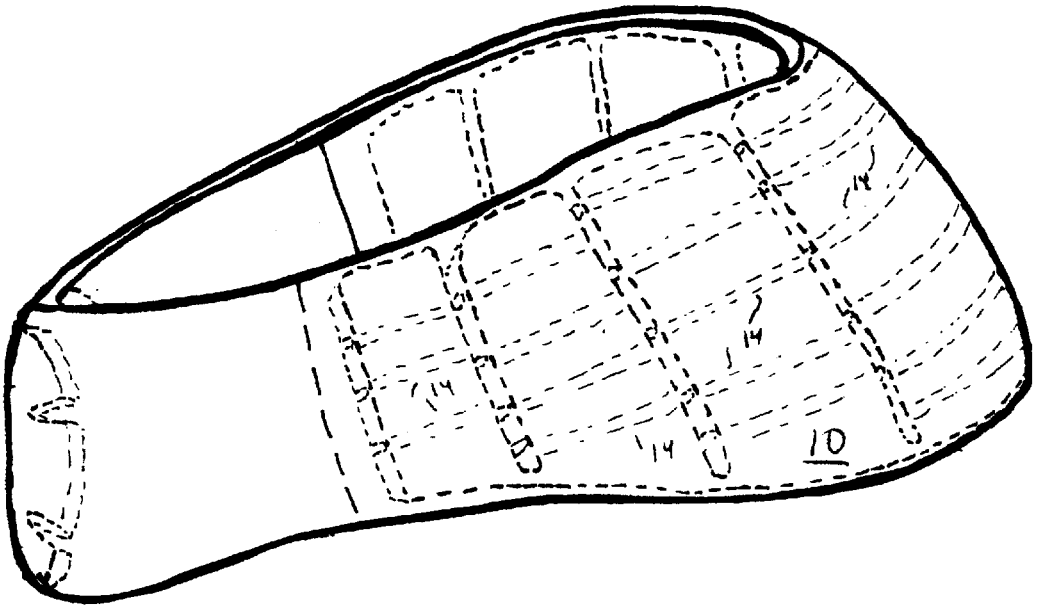
FIG. 5 Side view of an exemplary headguard showing placement of padding in one embodiment.
Figure 6:
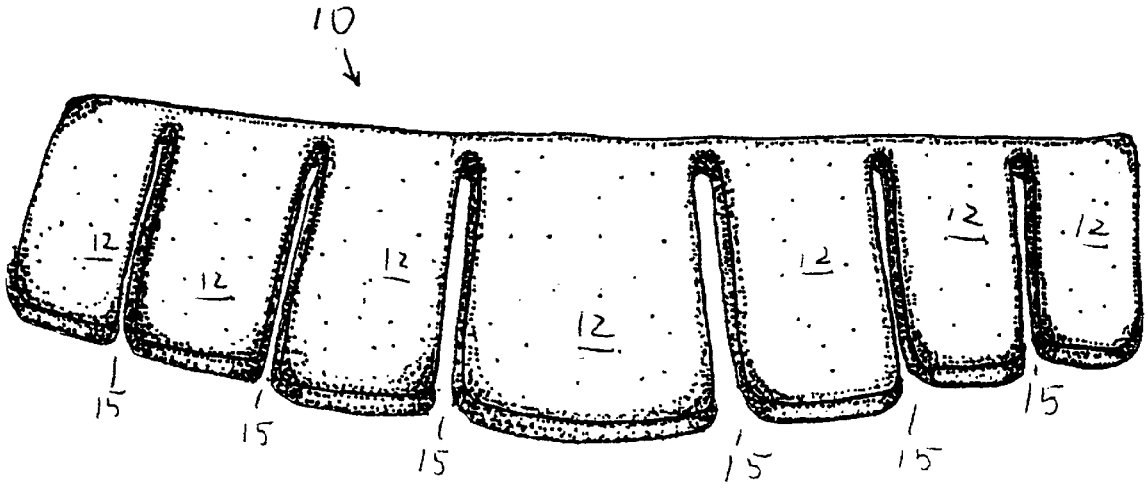
FIG. 6 Overview of padding for the front panel of one embodiment.
Figure 8:
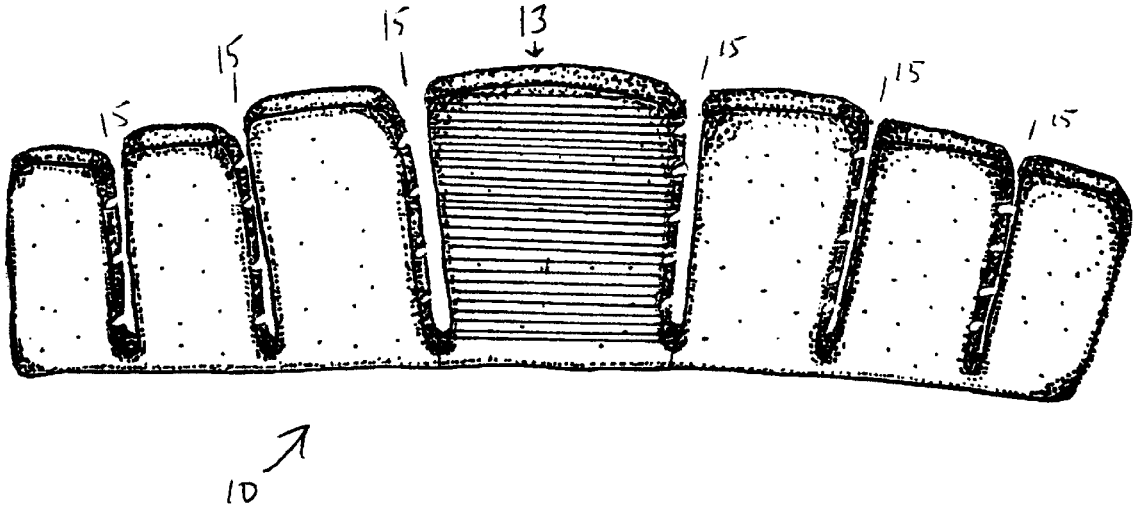
FIG. 8 Overview of padding for the front panel of one embodiment.

The fabric covering 1 may encase the padding in either sleeves or pockets. The padding may be located on the forehead area, the side of the head, and around the occipital bone. The padding may be of different materials. Die cut foam 6 may be used as shown in FIG. 3. In FIG. 3 one arrangement of foam 6 is shown. In this arrangement the pockets may have an opening along a line 7 allowing the foam 6 to be inserted into or removed from the pocket. In FIG. 4 vertically extending pockets 8 would encase the foam 6 or alternatively the foam 6 could be inserted into a sleeve created by the headband. In such an embodiment foams of different density or laminated foams could be deployed in the different pockets. For example, it may be desirable to have a harder foam in the section 9 covering the forehead. In FIG. 5 a one piece, sectioned foam front panel 10 is illustrated. This front panel 10 can be inserted into the sleeve created by the headband. It can also be removed for washing or replacement. The one-piece foam front panel 10 could have sections 12 molded into the piece as illustrated in FIG. 6. The sectioned front panel improves the ability of the front panel 3 to conform to the head. In addition, a sectioned front panel could have a laminated central section 13, with, for example, a harder foam on the exterior side as shown in FIG. 8.

Figure 7:
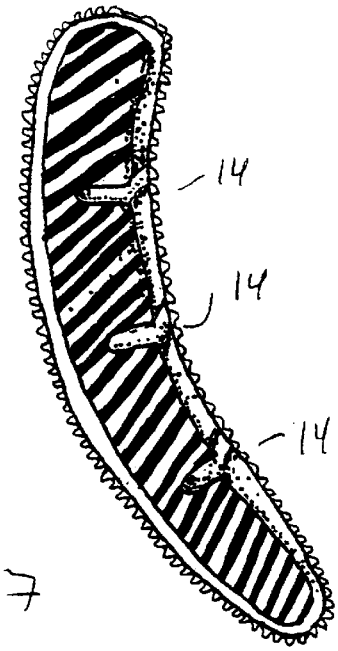
FIG. 7 Cut-away view of padding for one embodiment.

The foam may have channels 14 molded or cut into it. These channels 14 permit the foam to better accommodate the curving surfaces of the head. These channels 14 may run horizontally as shown in the headguard shown in FIGS. 5 and 7. A cross-section of the foam piece with the channels 14 curved as if it were conforming to the head is shown in FIG. 7. These channels 14 in combination with the spaces 15 between the sections of the panel aid the foam in conforming to the head.

Finally the foam could have pillows 16 on the interior side of the headguard. (Although not shown, pillows could also be placed on the exterior side of the foam.) The pillows 16 are upraised portions of the foam. The upraised foam pillows 16 have several purposes. First, the spacing between the pillows 16 improves the capacity of the panel to conform to the head. Second, the space between the pillows 16 ventilates the head when the headguard is worn. Third, the pillows 16 can provide a mechanism by which torsional forces applied to the headguard and head can be more effectively absorbed and reduced.

Torsional force applied to the head is undesirable for several reasons. Such forces twist the neck, exposing it to injury. Such forces increase the likelihood of acceleration injuries, especially angular acceleration injuries, to the brain. Such forces make it harder for the player to control the ball with the head. Thus, reduction in torsional forces can better protect the wearer and improve the wearer's ability to control a soccer ball.

Figure 9:
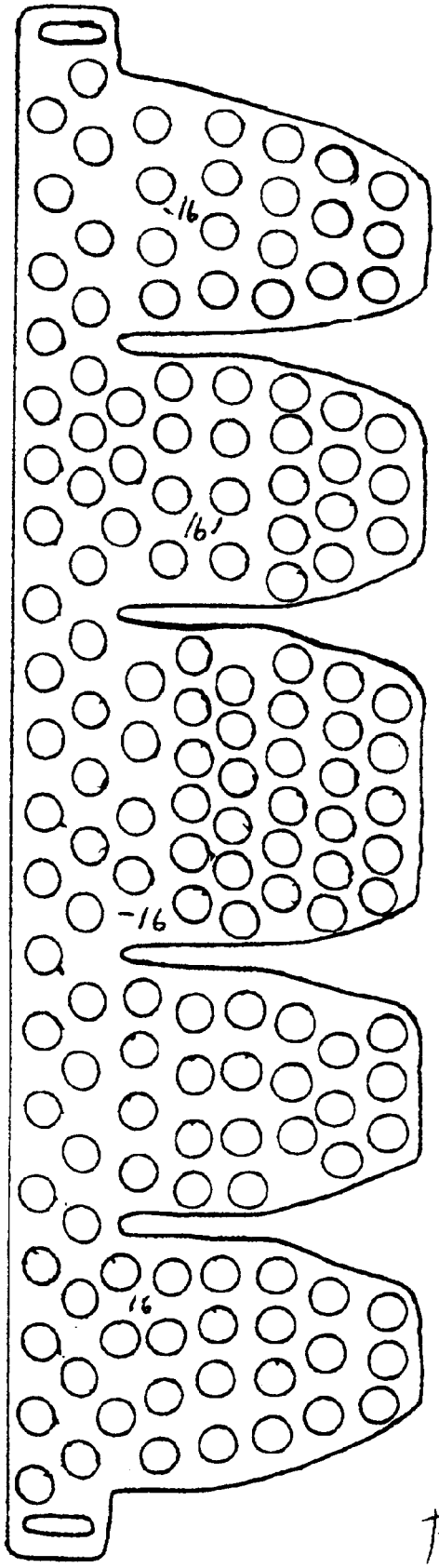
FIG. 9 Overview of padding for the front panel of one embodiment.
Figure 10:
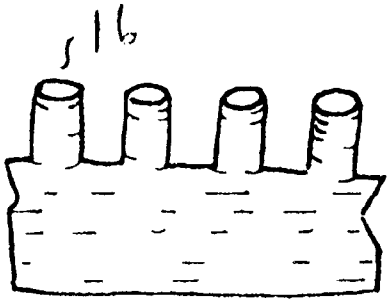
FIG. 10 Side view of one embodiment of padding.

An overview of one embodiment of the foam front panel 10 with pillows 16 is shown in FIG. 9. The pillows 16 in this embodiment are cylindrical upraised nubbins of foam. A close-up is shown in FIG. 10. The nubbins 16 could be of different sizes and shapes. A diameter or width of ⅛ to ½ inches and a height ⅛ to ½ inches would be suitable for many applications. Spacing between the nubbins 16 of ⅛ to ½ would also be suitable for many applications.

Figure 11:
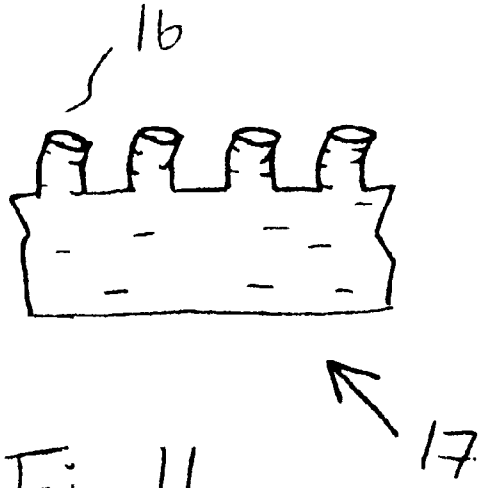
FIG. 11 Side view of one embodiment of padding being subjected to force.

The nubbins 16 work in the following fashion. If as shown in FIG. 11, force 17 is directed at an angle against the external surface of the headguard, for example, by a soccer ball, the nubbins 16 bend. This bending of the nubbins 16 absorbs the force and transfers less torsional force 17 to the head than solid foam would. Cylindrical pillows 16 such as these could be located on all panels of the headgear.

Figure 12:
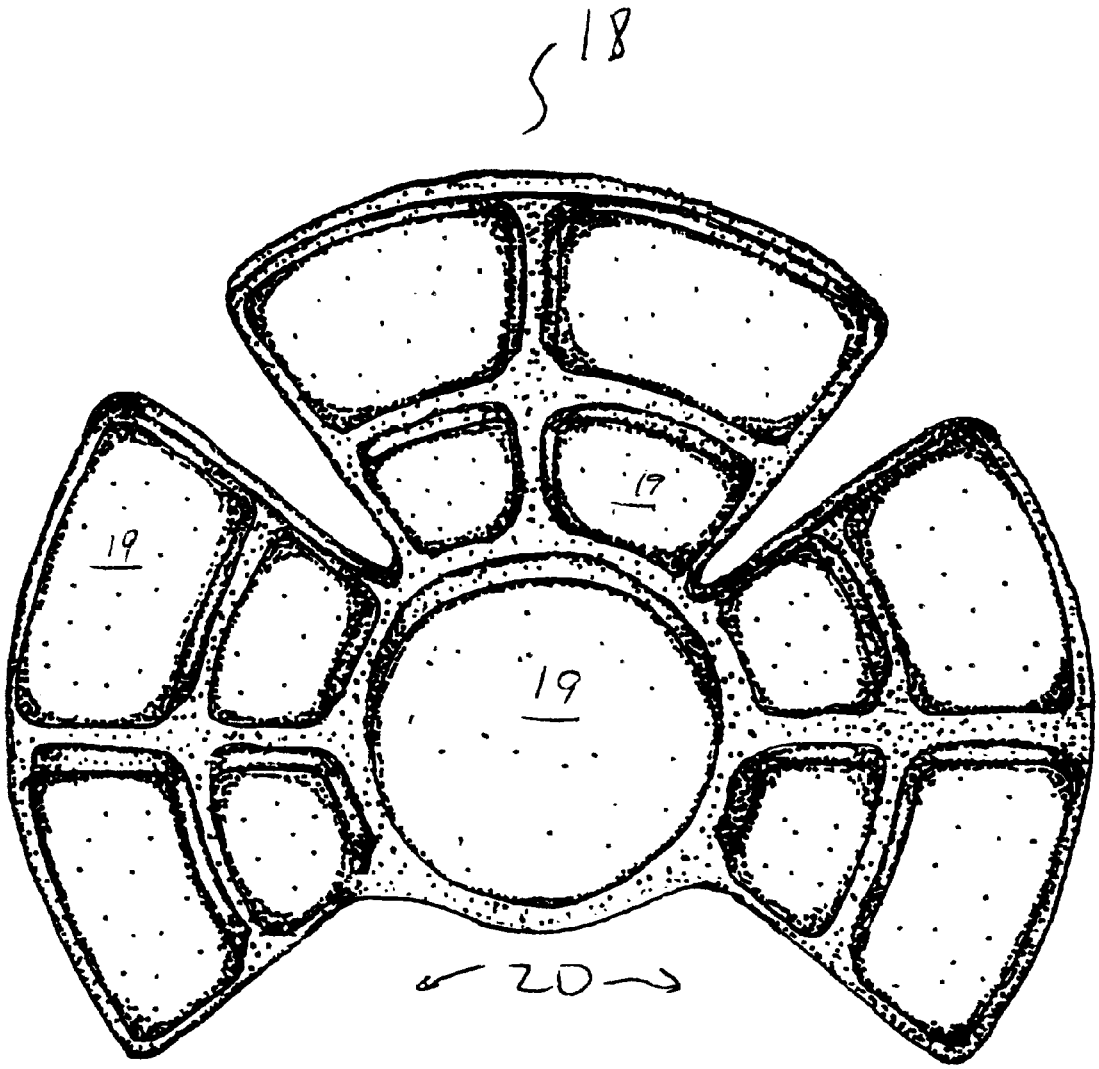
FIG. 12 Overview of one embodiment of padding for back panel.

The foam covering the occipital bone 2 may be shaped in a panel 18 such as one illustrated in FIG. 12. The cuts aid in conforming the back panel 18 to the occipital bone. The 1o pillows 19 illustrated in FIG. 12 are not intended as torsion absorbing pillows 16 but still would serve to conform the panel 18 to the head and to cool the head. Alternatively, Torsion absorbing pillows 16 such as those illustrated in FIGS. 9–11 could be used on the rear panel 18.

The rear panel 18 shown in FIG. 12 also has a notch 20 cut into the bottom portion of the panel 18. The wearer could run a ponytail through the notch 20.

Figure 13:
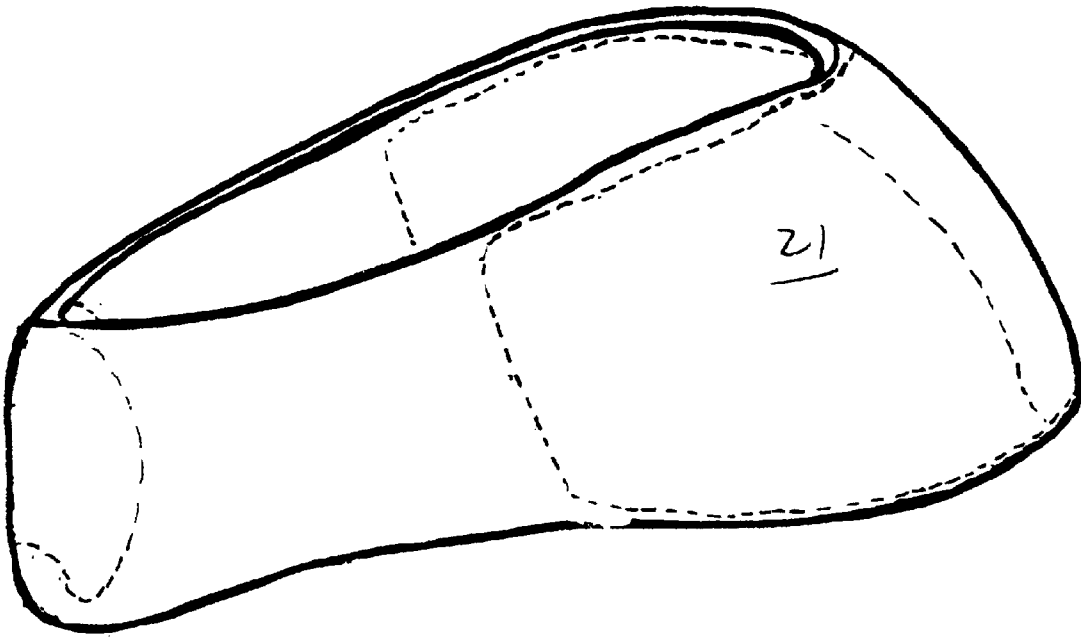
FIG. 13 Side view of internal configuration of padding in one embodiment.
Figure 14:
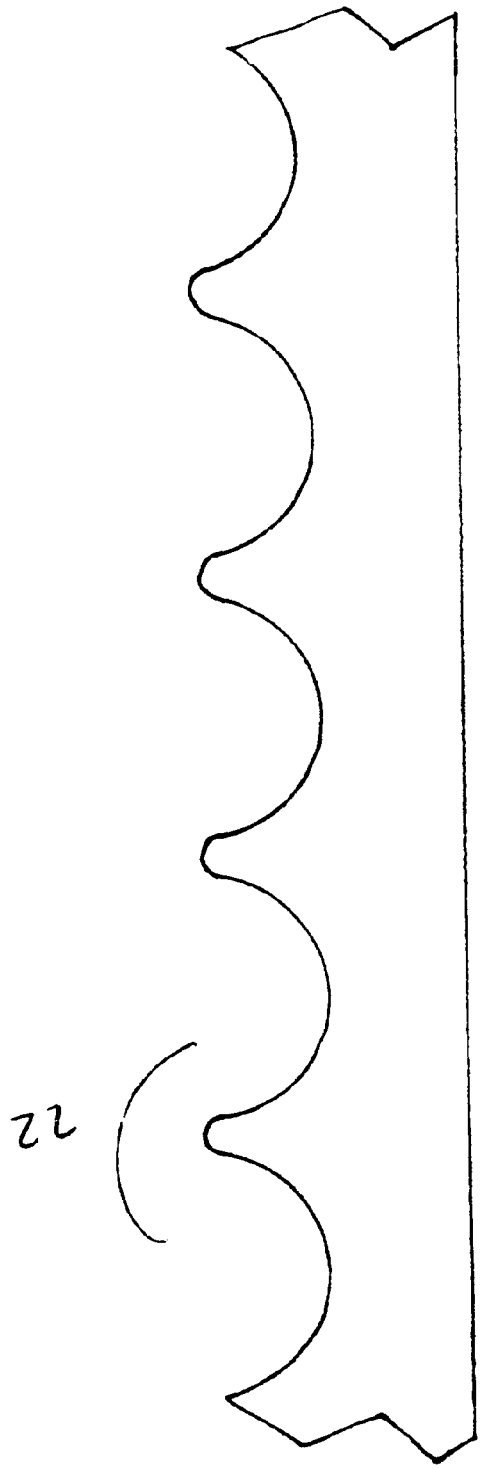
FIG. 14 Cut-away view one embodiment of padding.
Figure 15:
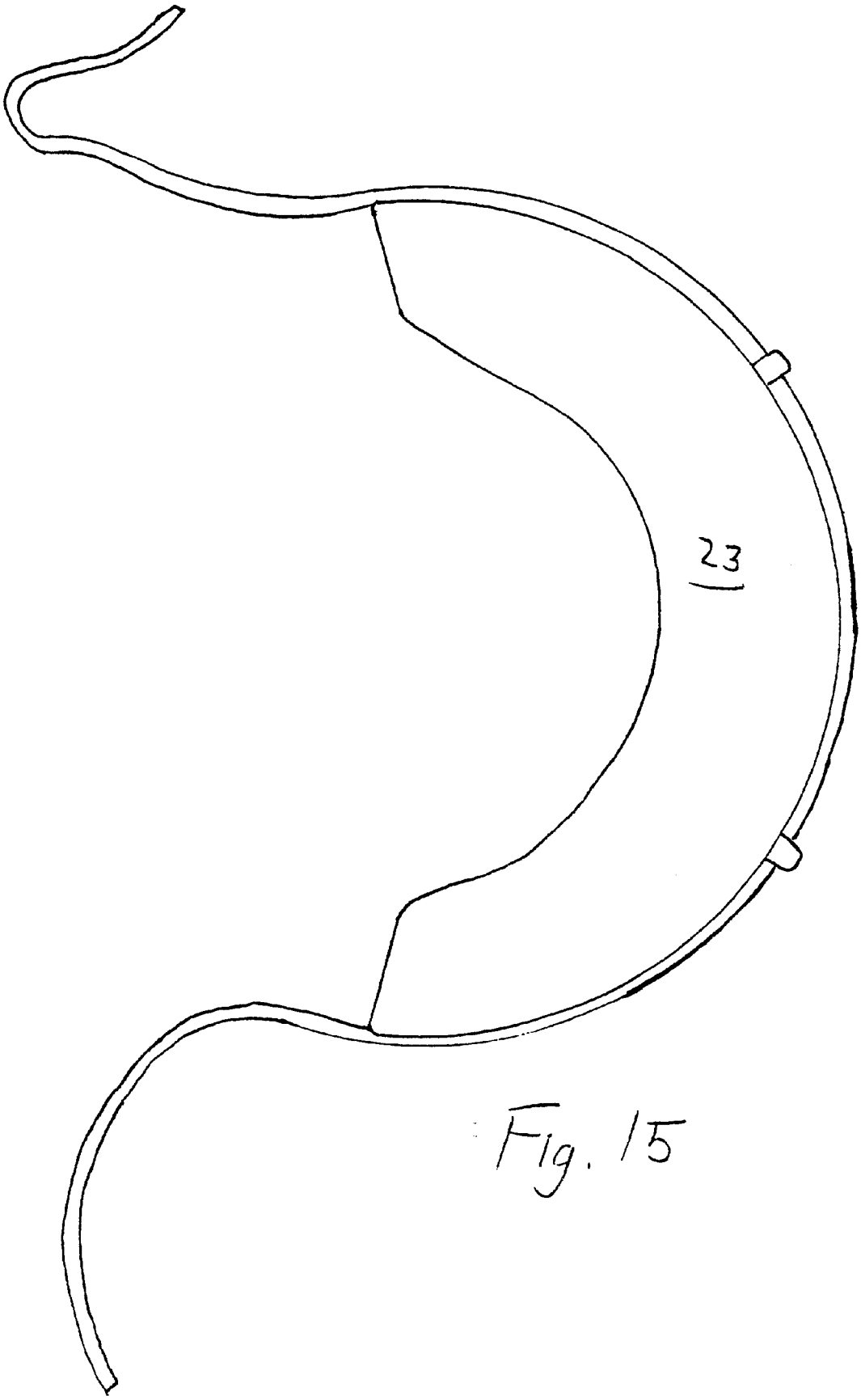
FIG. 15 Overview of one embodiment of the back panel.

As an alternative padding, injection molded foam could be used to create the panels. Injection molded panels could more readily be molded to a shape that conforms to the head. For example, as shown in FIG. 13, the front piece 21 could be molded in a shape that both accommodates the curve of the head from the forehead to the side of the head and the curve from the brow to the top of the head. Channels 22 could also be molded into the foam, as shown for example in FIG. 14, running vertically or horizontally to enhance cooling and to further enhance the flexibility of the headguard. If injection molded foam is used, a back panel 23 such as the one illustrated in FIG. 15 could be deployed. In FIG. 15, such an embodiment of the back panel 23 is viewed from above. This embodiment shows a back panel 23 molded into a curved tunnel running vertically. The foam would have sufficient stiffness such that when the headguard is placed on the head, a ponytail could be run through the tunnel created by the curvature of the back panel 23.

Figure 16:
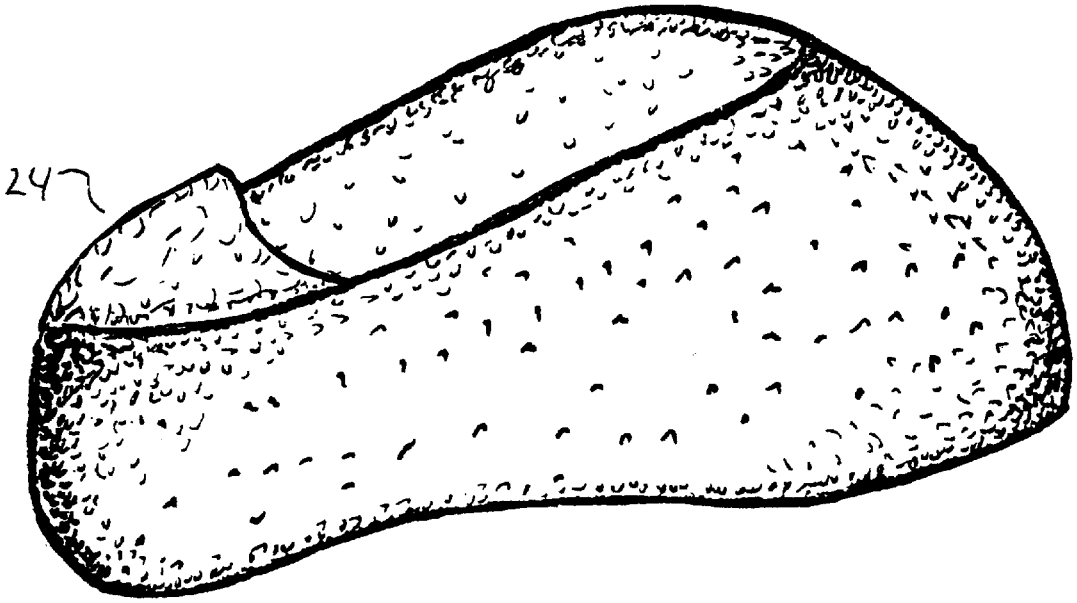
FIG. 16 Side view of one embodiment with panel of cooling material.
Figure 17:
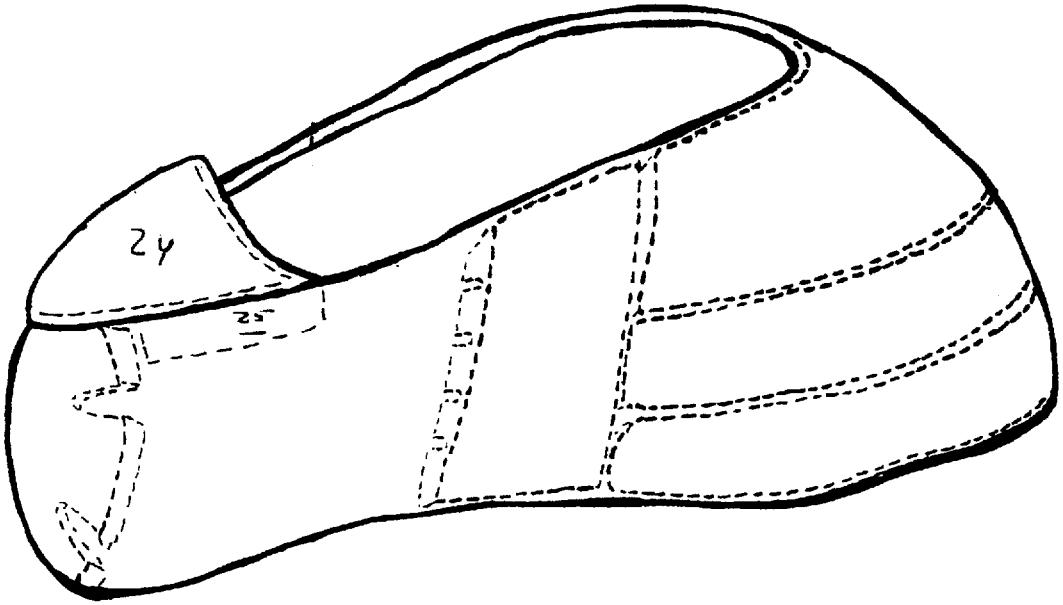
FIG. 17 Side view of internal configuration of padding and panel of cooling material.

Other materials could be used in place of foam. For example, gels or liquids could be introduced into packets which are then housed within the pockets of the fabric covering. Gels may have the added advantage of providing a means by which the head could be cooled when the wearer is subjected to warm conditions. The gels 24 could be of a type that retain cold better than foam. These packets 24 could be inserted into the pockets already identified for housing padding. Alternatively, the gel packs 24 could be placed in different areas such as ones which would not serve a primarily cushioning function but would serve to cool the head. For example, the gel pack 24 could attach to the headband at the back of the head above the back panel 4 of the headgear as illustrated in FIG. 16. The gel pack 24 could attach to the headband with hook and loop strips 25 as shown in FIG. 17.

Before use, the headgear or the gel packets 24 themselves would be placed into a refrigerator or other cool place. The gel material would retain the cold and keep the head of the wearer cooler.

Figure 18:
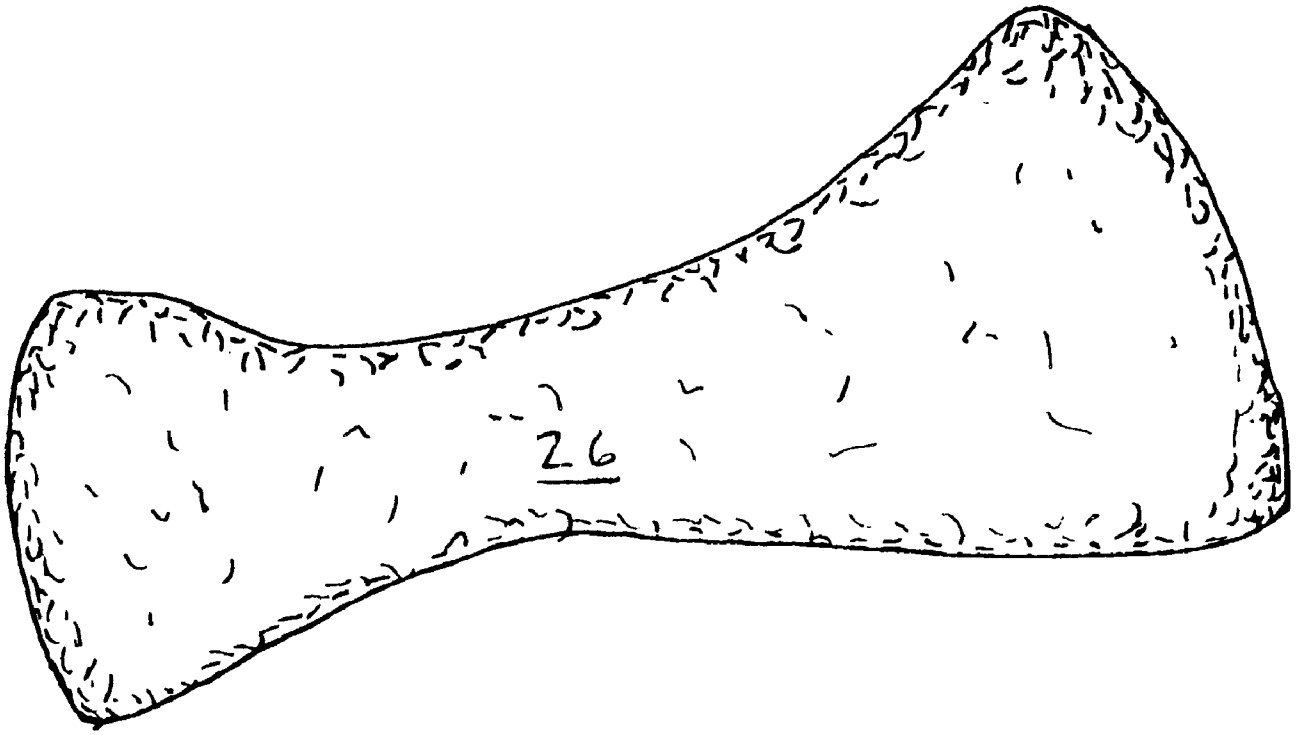
FIG. 18 Side view of one embodiment of headguard.
Figure 19:
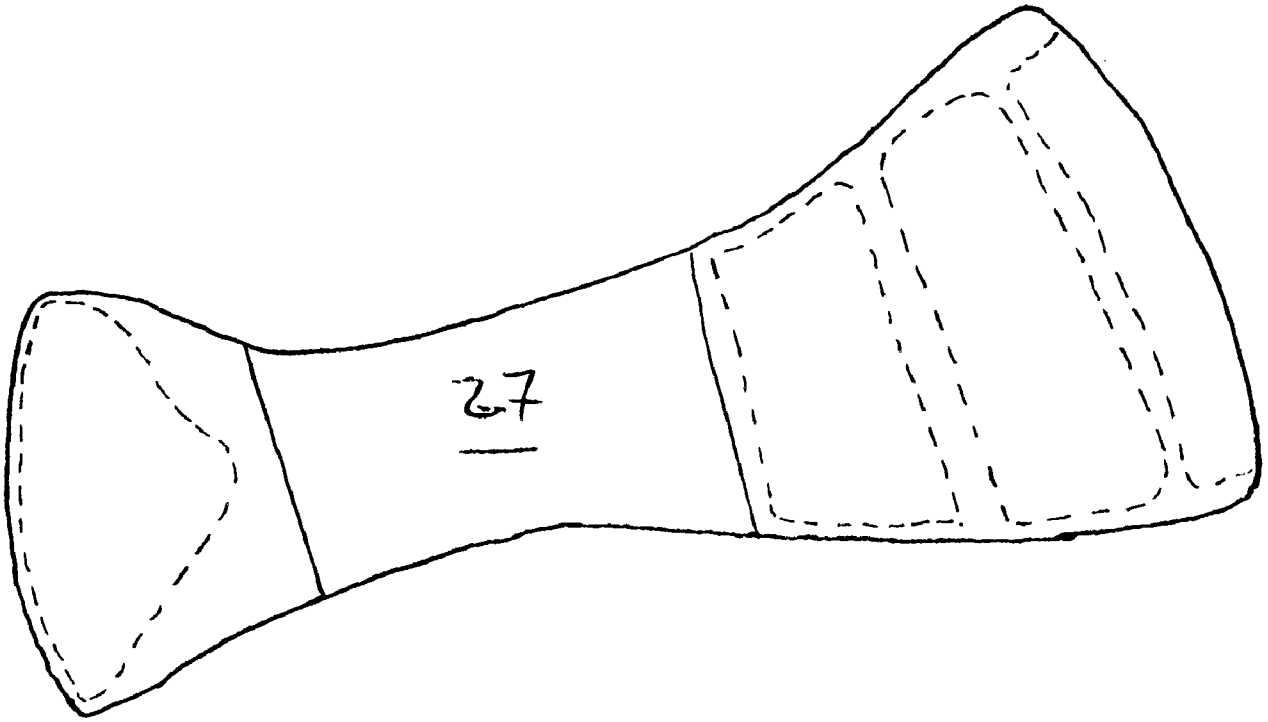
FIG. 19 Side view of internal configuration of one embodiment of padding.
Figure 20:
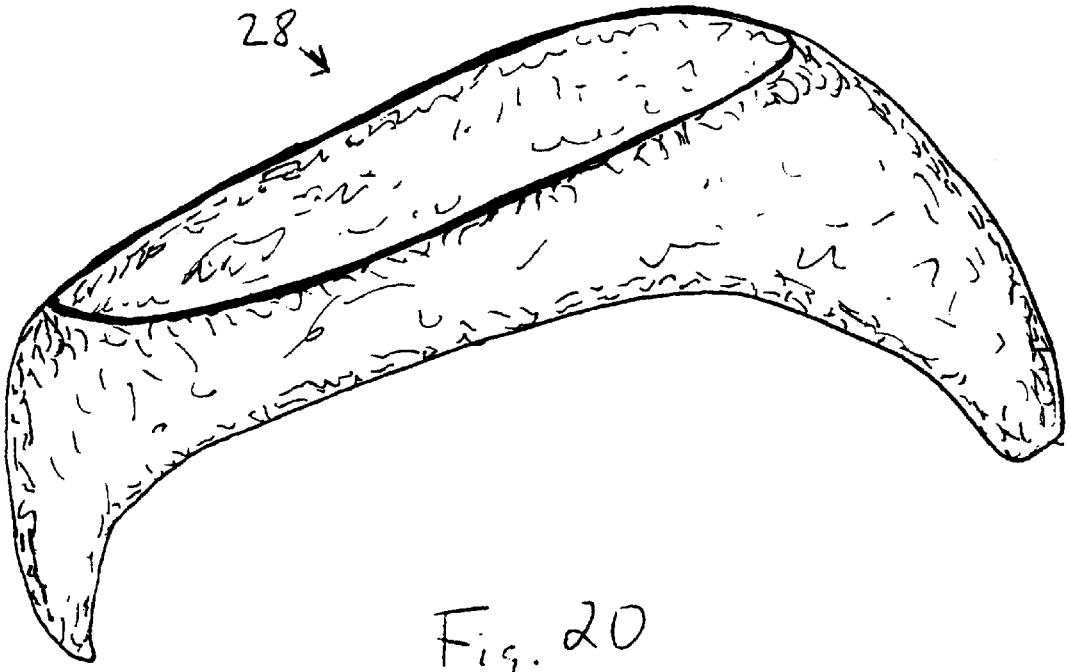
FIG. 20 Side view of one embodiment of headguard.

Another embodiment of the headguard 26 features a thinner profile as shown in FIG. 18. A possible arrangement of foam inserts is shown in FIG. 19. The piece 27 connecting the front and rear panels could be made of broad elastic. Another embodiment with a sleeker profile 28 is depicted in FIG. 20.

Figure 21:
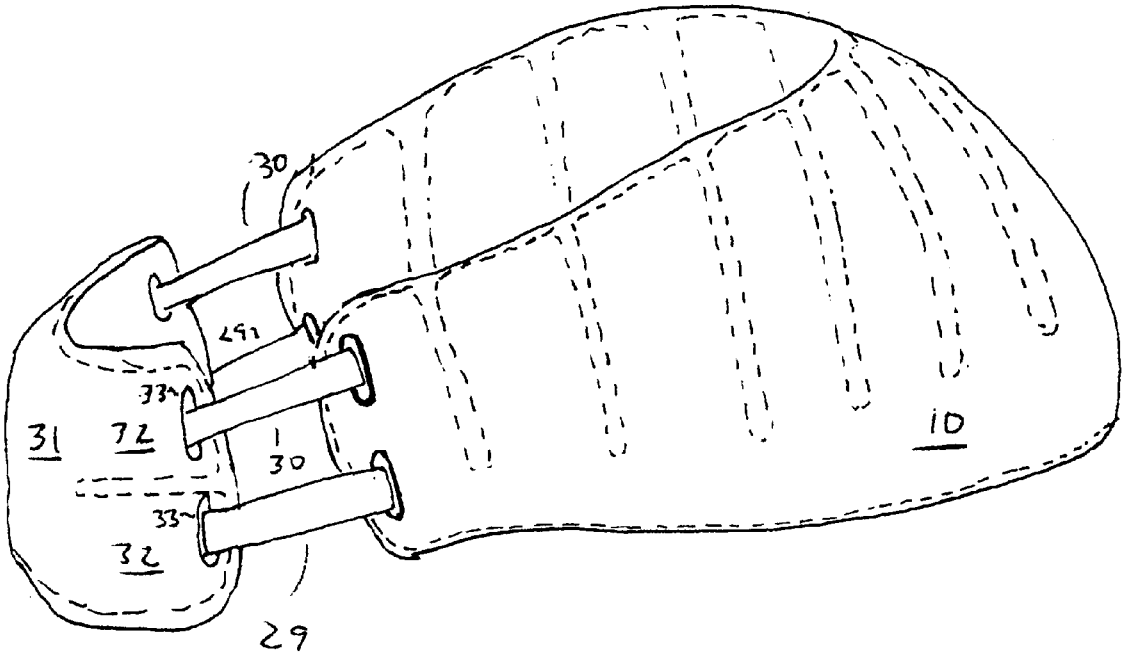
FIG. 21 Side view of one embodiment of headguard with adjustment straps.
Figure 22:
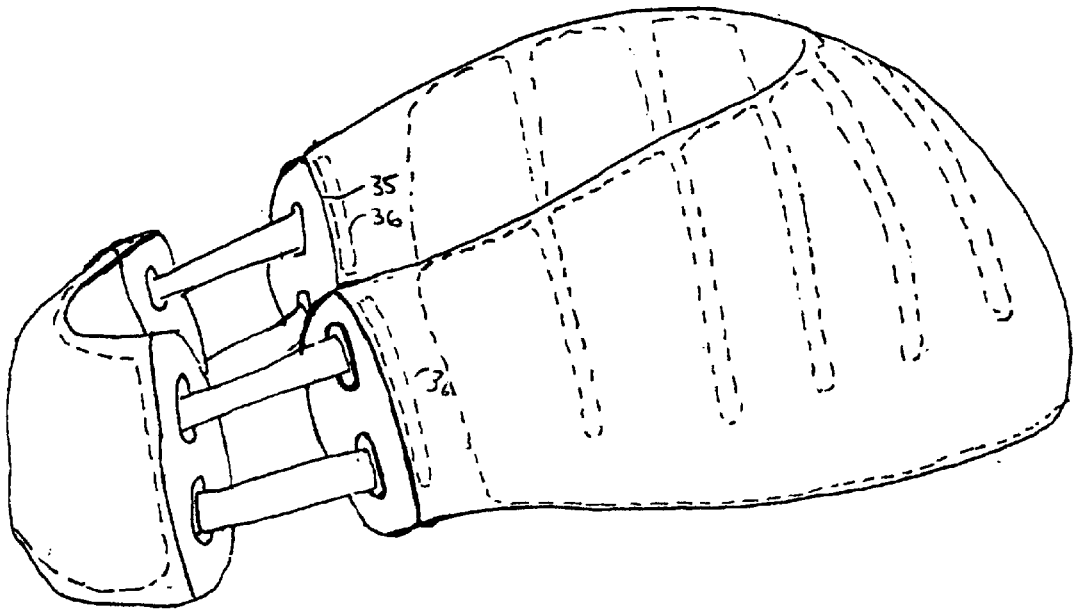
FIG. 22 Side view of internal configuration of padding in one embodiment of headguard with adjustment straps.
Figure 23:
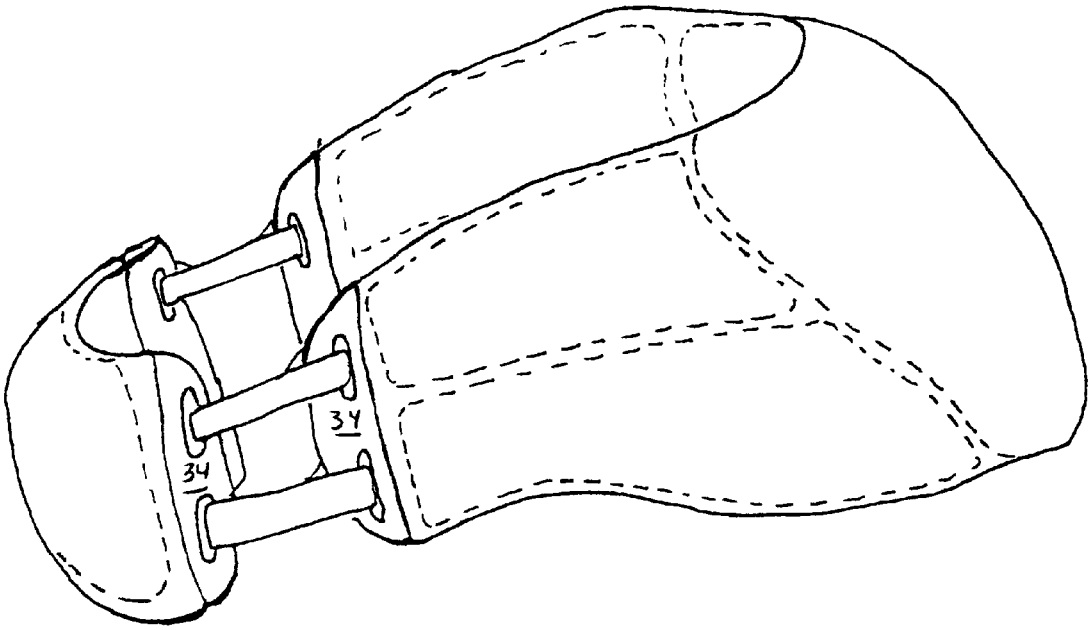
FIG. 23 Side view of internal configuration of padding in one embodiment of headguard with adjustment straps.

Another embodiment could incorporate adjustment straps 29, 30. These adjustment straps could be configured as shown in FIG. 21. In FIG. 21 the lower strap 29 would attach to the monolithic front panel 10. Tension placed on the lower adjustment strap would tighten the lower portion of the front panel 10 around the forehead thereby improving retention. The upper adjustment strap 30 would serve less as a means of retention and more as a sizing mechanism. Tension placed on the upper adjustment strap 30 would not tighten the entire upper portion of the foam front panel 10 but would tighten the fabric which would in turn bring the top parts of the padding inward toward the head. The rear panel 31 could have two ribs 32 at the forward edge of which slots 33 would be located and into which the adjustment straps 29, 30 could be inserted. Buttonhole type slots 33 could be sewn into the fabric covering for the front and rear panels. The seams of the fabric covering at the front of the rear panel and the rear of the front panel could be left open. The adjustment straps 29 and 30 running through the button hole slots 33 in the panels could hold the fabric covering in place on the panels. Alternatively a piece of heavy fabric 34 could be sewn to the front and rear panels as shown in FIGS. 22 and 23. These pieces of heavy fabric 34 would strengthen the attachment point for the adjustment straps 29, 30. In addition, a seam 35 could be opened (and closed with a hook and loop fastener 36) on the interior side of the headguard. All of these means of attaching the fabric covering 34 would allow it to be removed for washing or replacement.

Figure 24:
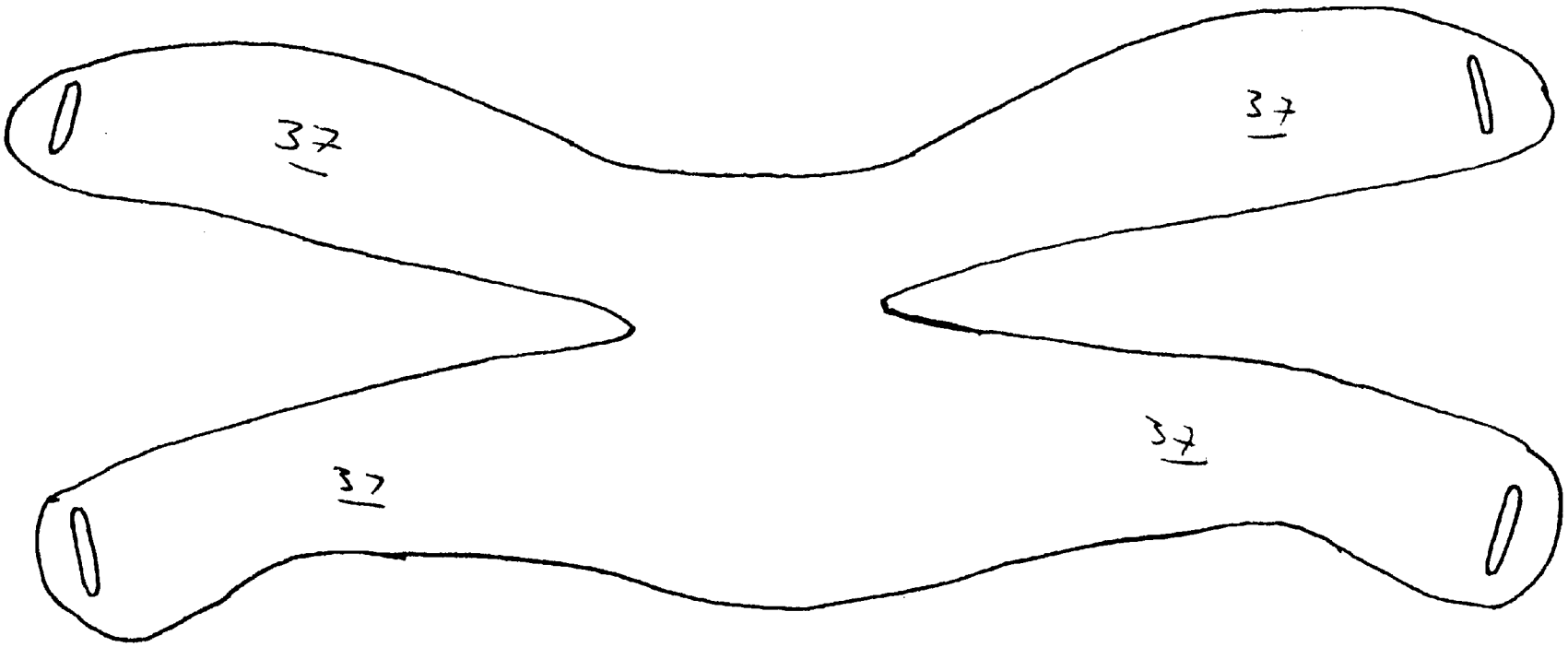
FIG. 24 Overview of one embodiment of padding for front panel.
Figure 25:
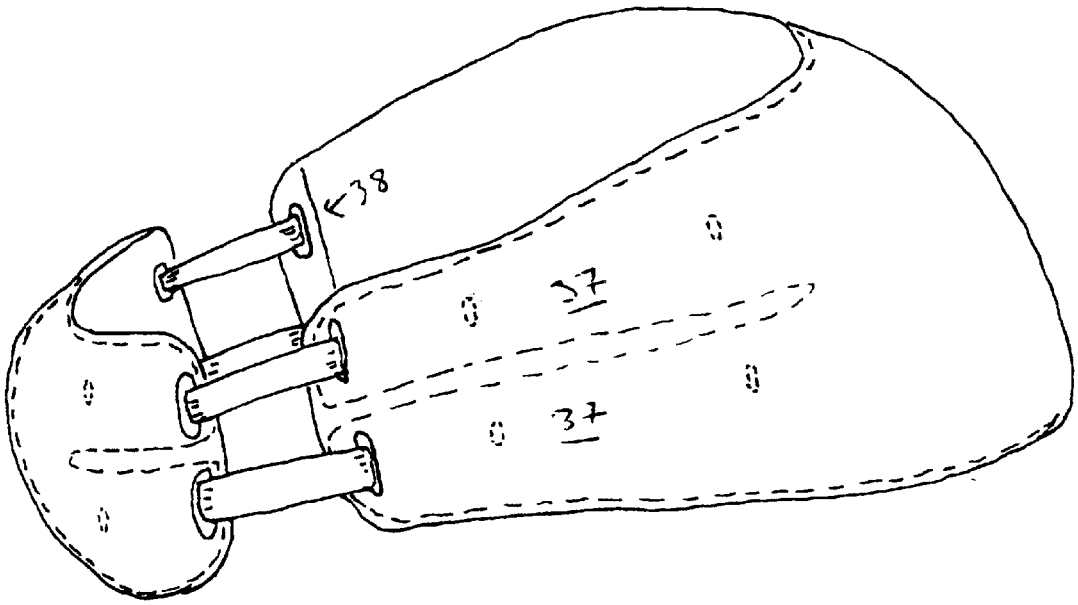
FIG. 25 Side view of internal configuration of padding in one embodiment of headguard with adjustment straps.

In another embodiment the front panel insert would have two horizontal ribs 37 on either side as illustrated in FIGS. 24 and 25. This front panel insert could be inserted into the front fabric covering through a seam 38 at the rear of the front panel covering.

Figure 26:
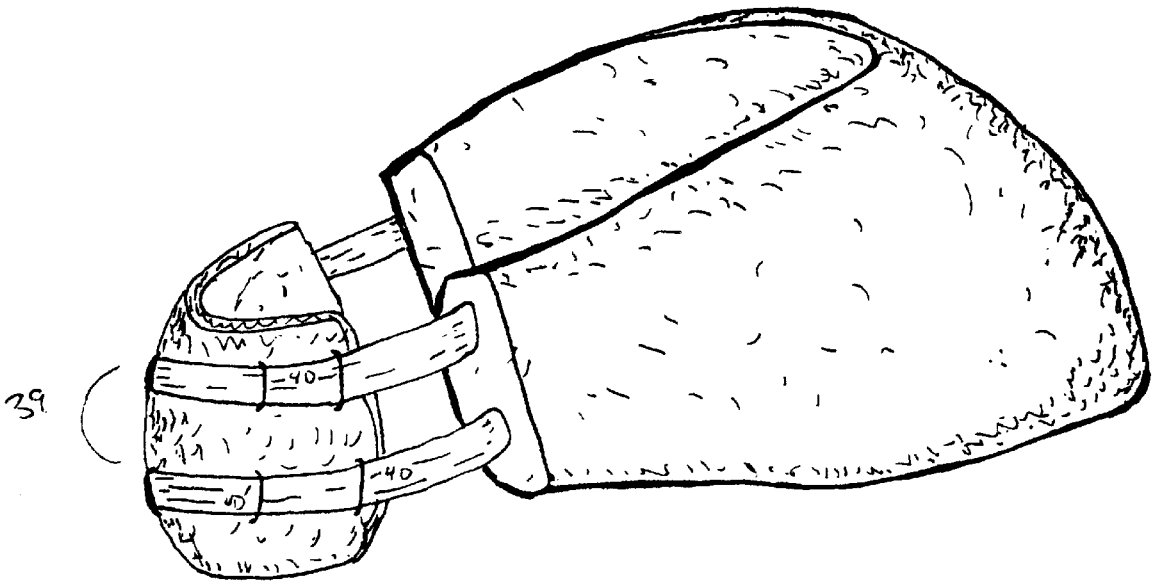
FIG. 26 Side view of one embodiment of headguard with adjustment straps.
Figure 27:
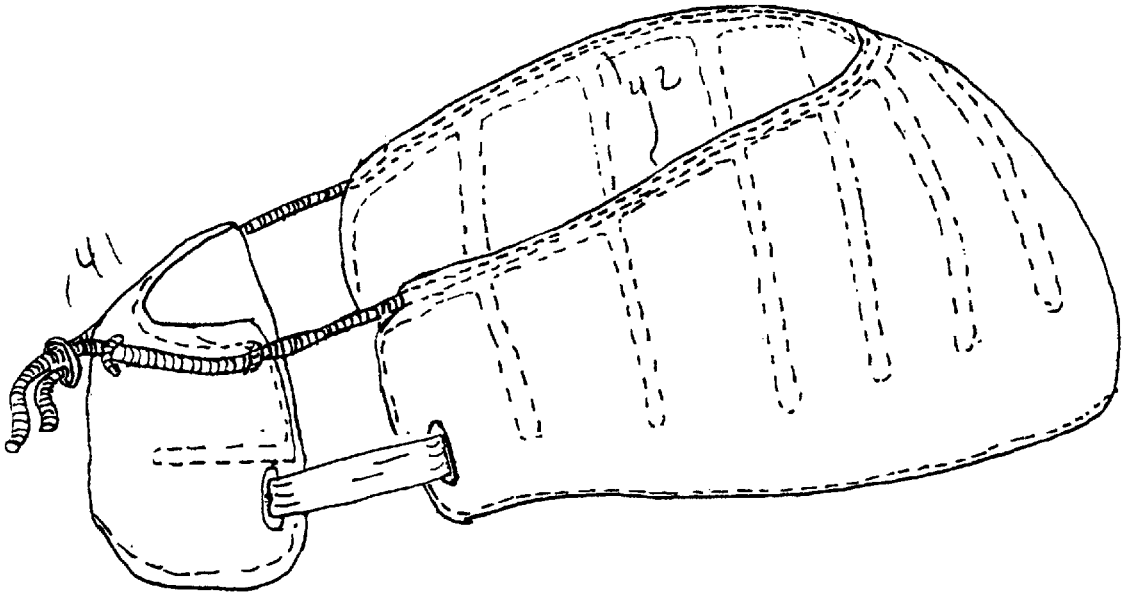
FIG. 27 Side view of one embodiment of headguard with adjustment cord.

Another embodiment includes adjustment straps 39 which encircle the rear panel 31 rips entirely as shown in FIG. 26. In this embodiment the straps 39 are held in position by small guide loops 40. One embodiment could feature an elastic cord 41 or other stretchable fabric strap on the top of the headguard as shown in FIG. 27. The elastic cord 41 could fit along the top edge 42 of the interior side of the front fabric covering. This cord 41 could be tightened and bring the edge of the headguard and hence the foam at the top of the headguard toward the head of the wearer to improve the fit.

Figure 28:
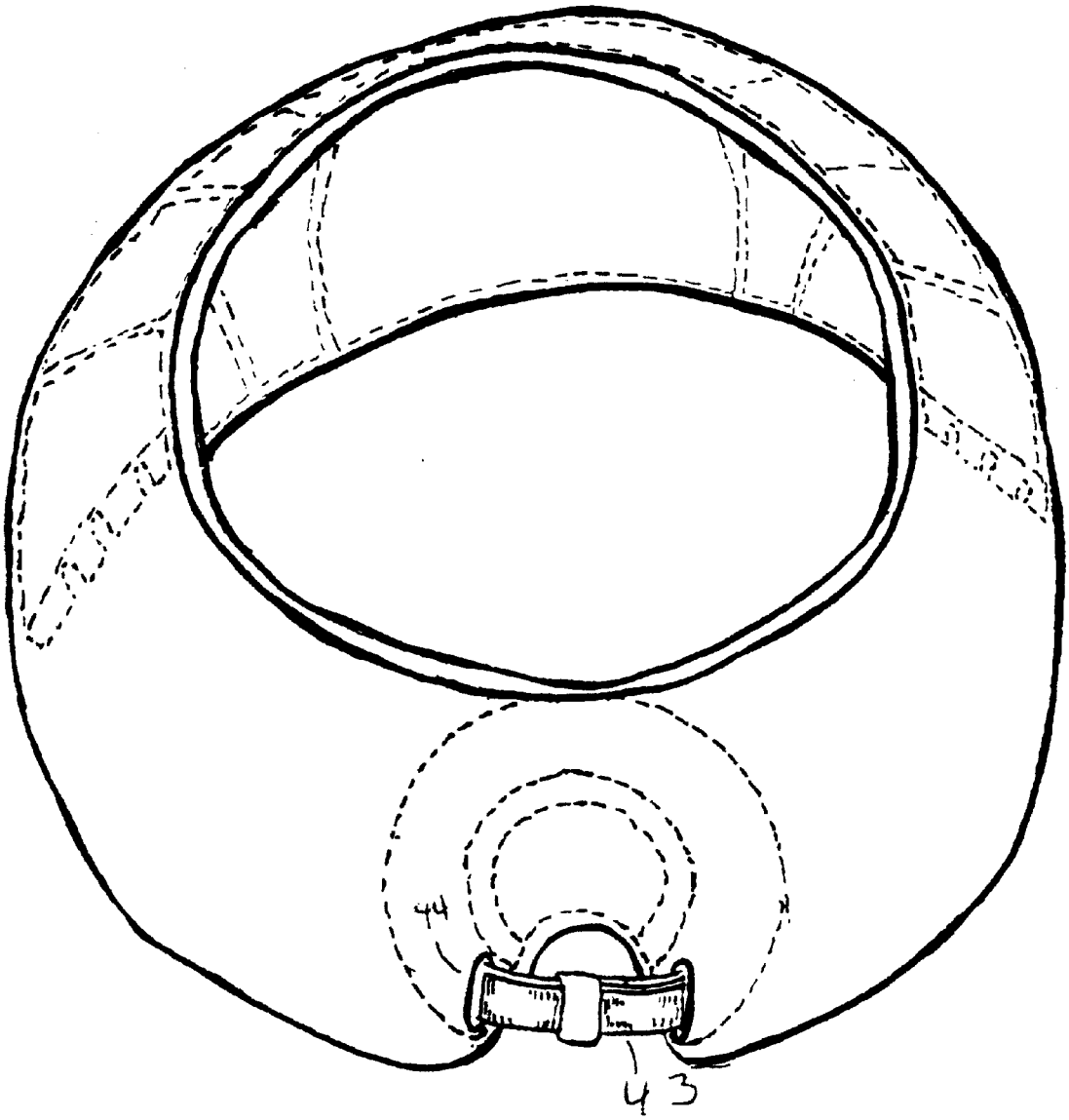
FIG. 28 Rear view of one embodiment of headguard with rear adjustment strap.

Another embodiment is shown in FIG. 28. This embodiment has an adjustment strap 43 at the back of the headguard. This adjustment strap 43 could be anchored in two slots 44 in the foam rear panel. Location of the adjustment strap 43 in this location would both tighten the lower edge of the headguard and would cup the rear panel to fit around the occipital bone.

Figure 29:
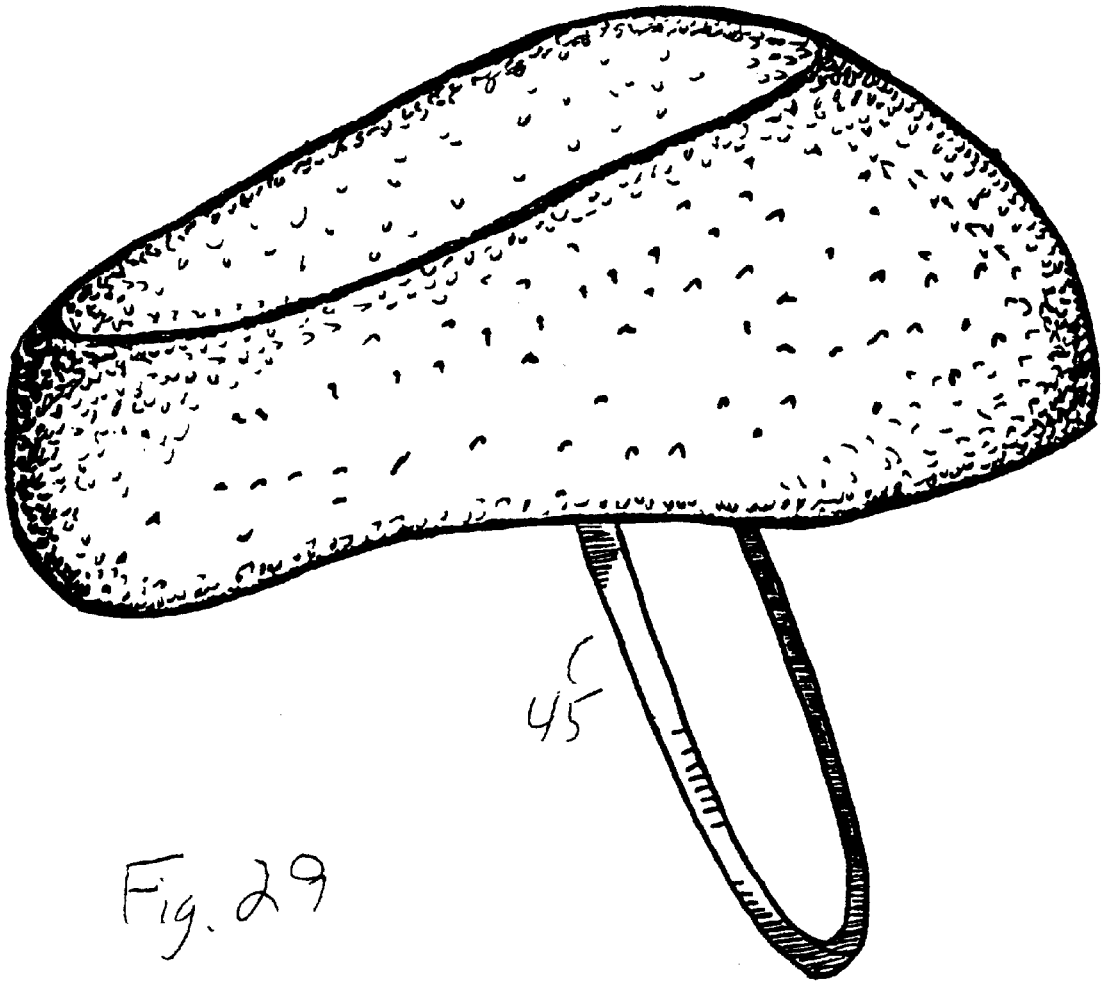
FIG. 29 Side view of one embodiment of headguard with chin strap.

A chin strap 45 could also be incorporated into the design as shown in FIG. 29. The chin strap 45 could be anchored to the headband with hook and loop which could allow the chin strap 45 to detach if sufficient twisting or tugging forces are applied to the headguard.

As noted above, the present invention provides a headguard which may be used in a number of different sports in which impacts to the head may occur. The present invention should not be considered limited to the particular examples described above, but rather should be understood to cover all aspects of the invention as fairly set out in the attached claims. For example, while suitable materials, fasteners, and the like have been disclosed in the above discussion, it should be appreciated that these are provided by way of example and not of limitation as a number of other materials, fasteners, and so forth may be used without departing from the invention. Various modifications as well as numerous structures to which the present invention may be applicable will be readily apparent to those of skill in the art to which the present invention is directed upon review of the present specifications. The claims are intended to cover such modifications and structures.

We claim:

1. An article of commerce comprising a protective headguard adapted to be worn by an athlete during participation in an athletic event and including at least:

(a) a protective central pad having interior and exterior surfaces with the central pad configured and arranged to cover at least a portion of the athlete's forehead when the headguard is worn;

(b) a rear pad having interior and exterior surfaces with the rear pad configured and arranged to cover at least a portion of the athlete's occipital bone when the headguard is worn; and (c) a sleeve interconnecting the central pad and the rear pad so as to hold the pads in position on the athletes head when the headguard is worn, and covering at least a portion of the interior and exterior surfaces of the central and rear pads.

2. The headguard of claim 1, wherein the sleeve is stretchable.

3. The headguard of claim 2, wherein the central and rear pads are laterally separated by a distance and at least that portion of the sleeve intermediate the central and rear pads is laterally stretchable so as to permit the distance between the pads to be increased when the sleeve is stretched.

4. The headguard of claim 2, wherein at least that portion of the sleeve covering the central pad is longitudinally stretchable.

5. The headguard of claim 2, wherein at least that portion of the sleeve covering the rear pad is longitudinally stretchable.

6. The headguard of claim 1, further comprising (i) a first side rib covered by the sleeve which is configured and arranged to cover at least a portion of a first side of the athlete's head when the headguard is worn and (ii) a second side rib covered by the sleeve which is configured and arranged to cover at least a portion of a second side of the athlete's head when the headguard is worn.

7. An article of commerce comprising a protective headguard adapted to be worn by an athlete during participation in an athletic event and including at least:

(a) a protective central pad having interior and exterior surfaces with the central pad configured and arranged to cover at least a portion of the athlete's forehead when the headguard is worn;

(b) a rear pad having interior and exterior surfaces with the rear pad configured and arranged to cover at least a portion of the athlete's occipital bone when the headguard is worn;

(c) a first sleeve removably covering at least a portion of the interior and exterior surfaces of the central pad;

(d) a second sleeve removably covering at least a portion of the interior and exterior surfaces of the rear pad; and (e) an adjustment strap system interconnecting the rear pad and the central pad.

8. The headguard of claim 7 further comprising (i) a first side rib covered by the first sleeve which is configured and arranged to cover at least a portion of a first side of the athlete's head when the headguard is worn and (ii) a second side rib covered by the first sleeve which is configured and arranged to cover at least a portion of a second side of the athlete's head when the lead guard is worn.

9. The headguard of claim 7, wherein (i) the central pad has an upper portion and a lower portion, (ii) the rear pad has an upper portion and a lower portion, and (iii) the adjustment strap system includes an upper adjustment strap interconnecting an upper portion of the rear pad and an upper portion of the central pad, and a lower adjustment strap interconnecting a lower portion of the rear pad and a lower portion of the central pad.

10. The headguard of claim 9, wherein at least one of the adjustment straps encircles substantially the entire head when the headguard is worn.

11. An article of commerce comprising a protective headguard adapted to be worn by an athlete during participation in an athletic event and including at least: (i) a sleeve, (ii) a pad retained by the sleeve, and (iii) a packet of cooling material retained by the sleeve.

12. The protective headguard of claim 11, wherein the packet is releasably retained by the sleeve.

13. The protective headguard of claim 11, wherein the pad and packet are encased within the sleeve.

14. A protective headguard to be worn by an athlete comprising a central pad configured and arranged to cover at least a portion of the athlete's forehead when the headguard is worn, wherein a plurality of individual nubbins project from at least a portion of an interior surface of the central pad.

15. The headguard of claim 14, wherein the nubbins are flexible and resilient.

* * * * *

UNITED STATES PATENT AND TRADEMARK OFFICE

CERTIFICATE OF CORRECTION

PATENT NO. : 6,397,399 B1
DATED : June 4, 2002
INVENTOR(S) : Lampe et al.

It is certified that error appears in the above-identified patent and that said Letters Patent is hereby corrected as shown below:

Column 5,
Line 24, replace “The lo pillows” with -- The pillows --

Column 6,
Line 46, replace “panel 31 rips entirely” with -- panel 31 entirely --

Signed and Sealed this

Twenty-first Day of January, 2003

JAMES E. ROGAN
*Director of the United States Patent and Trademark Office*